United States Patent [19]

Belbel et al.

[11] Patent Number: 4,562,323

[45] Date of Patent: Dec. 31, 1985

[54] SWITCH DEVICE HAVING AN INSULATING SCREEN INSERTED BETWEEN THE CONTACTS DURING BREAKING AND MEANS FOR SHEARING THE ARC BETWEEN THIS SCREEN AND AN INSULATING WALL

[75] Inventors: Elie Belbel, Epinay; Christian Blanchard, Nanterre; André Haury, Le Raincy; Michel Lauraire, Courbevoie, all of France

[73] Assignee: La Telemecanique Electrique, France

[21] Appl. No.: 576,983

[22] Filed: Feb. 3, 1984

[30] Foreign Application Priority Data

Feb. 4, 1983 [FR] France ..... 83 01749

[51] Int. Cl.[4] ..... H01H 33/06

[52] U.S. Cl. ..... 200/151

[58] Field of Search ..... 200/151

[56] References Cited

U.S. PATENT DOCUMENTS

| | | | |
|---|---|---|---|
| 751,028 | 2/1904 | Thomson | 200/151 |
| 1,833,173 | 11/1931 | Murray | 200/151 |
| 2,477,837 | 8/1949 | Strom | 200/151 |
| 3,129,307 | 4/1964 | De Vargas | 200/151 |
| 3,281,561 | 10/1966 | Mary et al. | 200/151 |
| 3,842,228 | 10/1974 | Green | 200/151 |
| 4,426,562 | 1/1984 | Kemeny | 200/151 |
| 4,467,298 | 8/1984 | Belbel et al. | 200/151 |

FOREIGN PATENT DOCUMENTS

| | | | |
|---|---|---|---|
| 472305 | 2/1929 | Fed. Rep. of Germany | 200/151 |
| 591598 | 1/1934 | Fed. Rep. of Germany | 200/151 |

*Primary Examiner*—Robert S. Macon

[57] ABSTRACT

A switch device is provided comprising means for controlling the separation of the contacts and for inserting an electrically insulating screen between the contacts during opening thereof, said screen cooperating with an electrically insulating surface formed by one of the walls of a substantially closed arc chamber, for shearing the arc between the contacts, the control of the movement of the screen being obtained by propulsion means essentially separate from those causing the separation of the contacts, while the whole is arranged so that substantially complete shearing of the arc is obtained before it has had time to stabilize itself, substantially total sealing being obtained between the screen and said surface when they are in abutment.

13 Claims, 22 Drawing Figures

FIG. 5
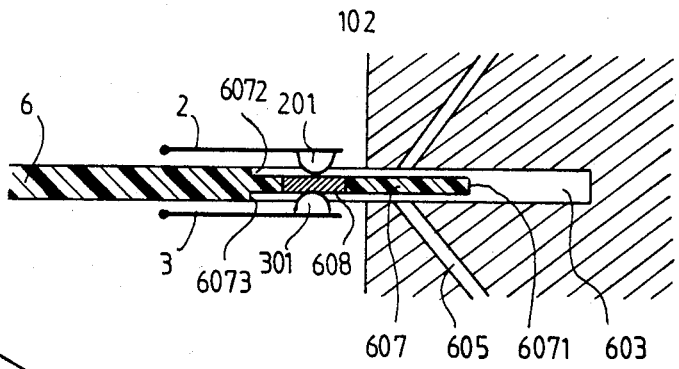
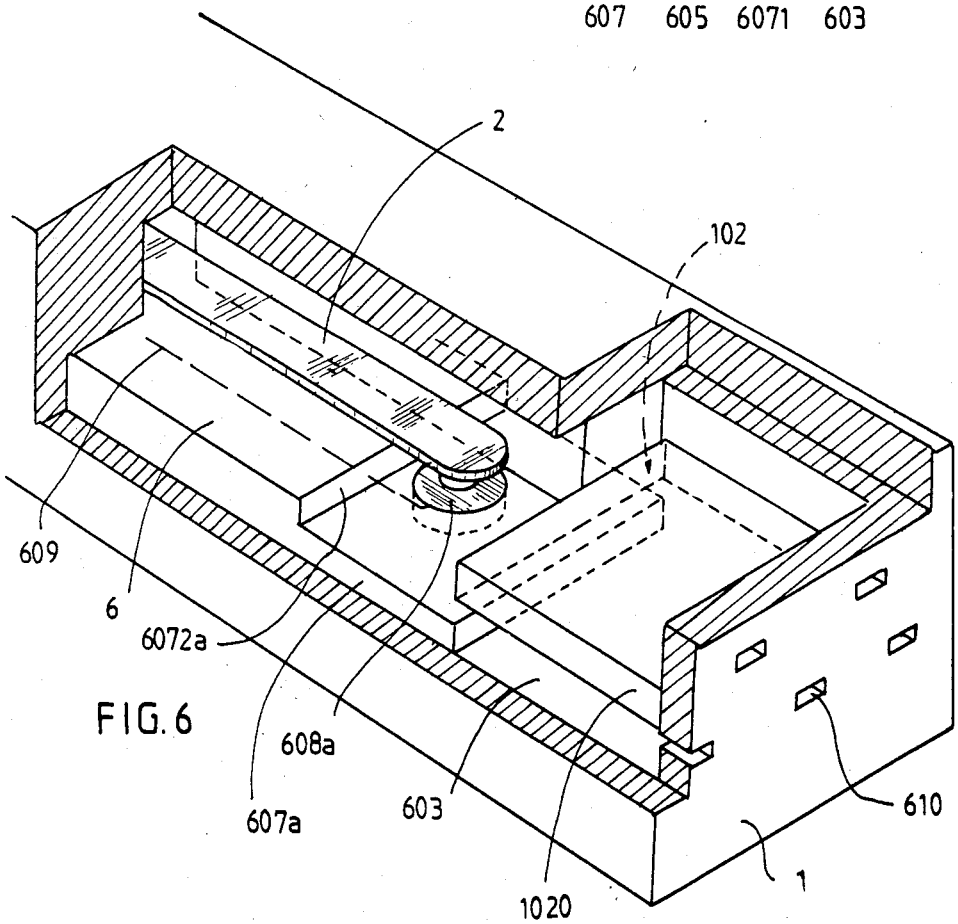
FIG. 6

SWITCH DEVICE HAVING AN INSULATING SCREEN INSERTED BETWEEN THE CONTACTS DURING BREAKING AND MEANS FOR SHEARING THE ARC BETWEEN THIS SCREEN AND AN INSULATING WALL

BACKGROUND OF THE INVENTION

1. Field of the Invention

The invention relates to the extinction of the electric arc which occurs during breaking of a circuit by a switch device, under DC or AC operation.

It relates more particularly to low and medium voltage breaking apparatus (going for example from 110 V to 5 KV) in which the discharge occurs in the air and more especially those in which an electrically insulating screen is interposed between the contacts so as to promote rapid extinction of the arc and to prevent it from restriking.

These apparatus comprise: limiters where the separation of the contacts is for example obtained by means of electrodynamic repulsion forces which are exerted in conducting portions supporting the contacts when the current which flows through them exceeds a predetermined threshold, other types of circuit breakers where the separation of the contacts is obtained by releasing accumulated mechanical energy or by the magnetic energy developed by a short circuit and even some contactors.

2. Description of the Prior Art

In the Prior Art, the breaking technique principally used, in the above mentioned range, an extension effect of the arc.

Now, the arc voltage which is caused to increase as much as possible so as to cause extinction depends, not only on its length, but also on the electric field which is proportional to the intensity of the current and inversely proportional, on the one hand to the conductivity and on the other to the section of the arc. This latter factor has not been used up to now systematically with appropriate measures taken for controlling it so as to increase the arc voltage.

The applicant has discovered that a much more rapid extinction of the arc is obtained if, all other things being equal, a practically complete shearing of the arc is effected between the screen and an electrically insulating wall with which it cooperates, on the express condition that the screen moves at a sufficient speed for continually destabilizing the arc from the moment when it occurs to the effective moment of shearing, and that the breaking chamber is adapted so as to offer no leak path for the arc, outside the path along which the destabilization takes place. When these conditions are fulfilled, the arc voltage increases practically as quickly as in a fuse.

According to the patent DT No. 84 9138, filed on July 8, 1949, two pivoting shutters pivot back towards a central wall with which they come into contact so as to interpose an obstacle in the paths of the arc between two respective pairs of contacts. However, after separation, the arrangement is such that the shutters take up their pivoted back position in a time equal to the time for opening the contacts, which is moreover relatively long, because this opening is controlled by mechanical means. The arc may therefore stabilize itself and it is neither indicated, nor probable, that its extinction is caused by the subsequent interposition of the screen, rather than by the zero cross-over of the current. This device seems in fact intended for preventing the arc from restriking; before extinction of the arc, this latter is in contact with the screen for a relatively long time, which results in a considerable risk of metallization of the screen by the arc. Furthermore, constriction is not completely provided and leak paths are not avoided; finally, the whole of the structure is neither reliable, nor capable of providing efficient operation for a long period of time.

According to the published patent application DT No. 1010618, filed on Jan. 21, 1952, the screen undergoing a translational movement perpendicular to the direction of separation of the contacts, is only inserted between the contact pieces after these latter have been moved away from each other by the cooperation, with their support blades, of bosses with which it is provided. The means for opening the contacts is here united with the means for propelling the screen and this latter must completely overcome the pressure containing the contacts in the closed condition. It follows necessarily that the interposition in the path of the arc of the screen thus braked in its translational movement occurs after a relatively long time, so that the arc will have time to stabilize itself. A blowout coil is moreover disposed in the vicinity of the contact pieces for urging the arc thus formed towards a slit into which the edge of the screen penetrates. Stifling of the arc only takes place after it has undergone considerable lengthening and the whole device is housed in a very resistant sealed chamber so that an overpressure is created; these two factors (lengthening and overpressure) contribute to increasing the arc voltage: in so far as the stifling is concerned, it is neither indicated, nor probable that it is complete and that it forms an appreciable factor contributing to the extinction.

SUMMARY OF THE INVENTION

According to the invention, the substantially complete shearing of the arc before it has time to stabilize itself is obtained by controlling a sufficiently rapid movement of the screen by means of a member independent of the member controlling the separation of the contacts and by adapting the cooperating surfaces of the end edge of the screen and of the insulating wall so that substantially complete sealing is obtained therebetween when the screen has come into abutment against said wall.

In a preferred embodiment, the linear speed of movement of the screen is greater than 2 m/s.

According to another aspect of the invention, the screen is guided in its movement by a groove adapted for providing lateral sealing.

BRIEF DESCRIPTION OF THE DRAWINGS

Other features, as well as the advantages of the invention will appear clearly from the following description.

In the accompanying drawings:

FIG. 5 shows schematically and partially one embodiment in which the screen is extended by a median blade in which a conducting piece is embedded;

FIG. 6 is the partially exploded perspective view of a switch device with a single mobile contact, with a staircase screen;

BRIEF DESCRIPTION OF THE EMBODIMENTS

Figure 1:
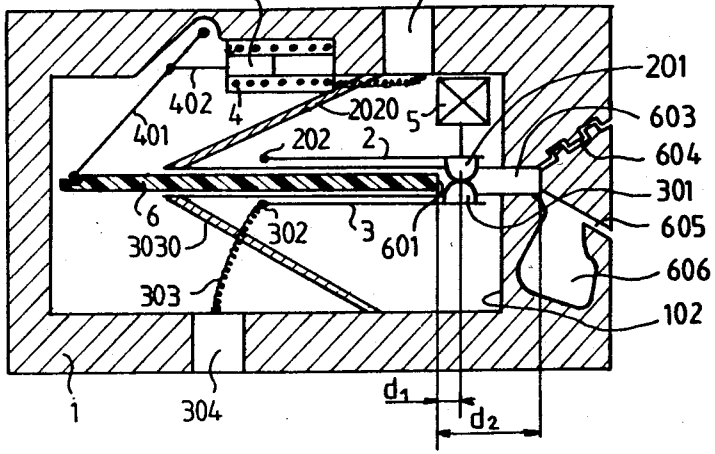
FIG. 1 is a simplified diagram, seen in longitudinal section through the median plane I—I of FIG. 2, of a switch device using the invention, with the contacts in the closed position.
Figure 3:
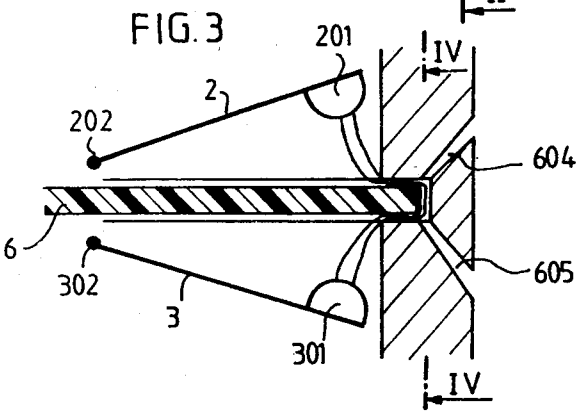
FIG. 3 is a partial view, on a larger scale, showing the open contacts.

In FIGS. 1 to 4, a switch device has been shown comprising, housed in a case 1, two contact supports 2 and 3 provided with contact pieces 201 and 301 and adapted to pivot about points 202–202'. This latter support is connected by a conductor 303 to a connection terminal 304. A coil 4 is supplied with power from a connection terminal 204.

At 5 have been shown symbolically means which, for the sake of convenience, will be called hereafter "lock for controlling the opening of the contacts" 2-201 and 3-301. For a circuit breaking apparatus, these means will respond for example to a predetermined current overintensity corresponding to a short circuit and may be of different known types: thermal response members such as bimetallic strips, electromagnetic response members such as coils or electrodynamic response members (repulsion forces exerted between the conducting supports of the contacts).

A screen 6 made from an electrically insulating material and, advantageously, a good heat conductor is disposed between the contact supports 2–3 and parallel thereto when they are at rest. The front edge 601 of this screen is situated at a small distance $d_1$ to the rear of the contact point. This screen is propelled forwardly by means which have been shown symbolically here by coil 4 and a system of levers 401–402 connected to a plunger core 403 with which it is provided. These means are, in the examples shown, electromagnetic and actuated by the effect of the short circuit current. However, they could be of different types: for example, a loaded spring tripped at the desired moment, or others.

It should however be emphasized that these propelling means must be adapted to communicate to the screen a considerable translational speed, at least equal to 2 m/s and which will in practice often be of the order of 10 to 20 m/s, as will be explained further on. That means necessarily that the movement of the screen should not be substantially braked by the contacts and that the screen should therefore not be used for opening them by a mechanical action which it exerts thereon for overcoming the pressure holding them in the closed condition; the movement of the screen should not be dependent on the complete opening of the contacts, for it must insert itself therebetween as soon as the arc has begun to strike, so as to ensure destabilization thereof. This is why it is necessary for the lock and the propelling means to be essentially separate. It is however possible that the screen, whose movement is very rapid, may strike the contact pieces before they have had the time to separate and exert on the contacts an action unlocking their propelling members: the essential thing is that this action should only concern the tripping, the movement of the contacts then being independent of that of the screen.

Figure 2:
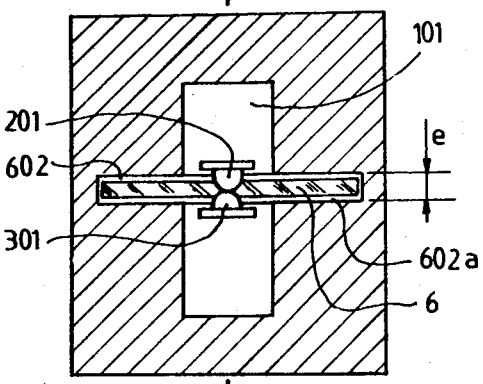
FIG. 2 is a section through II—II of FIG. 1.
Figure 4:
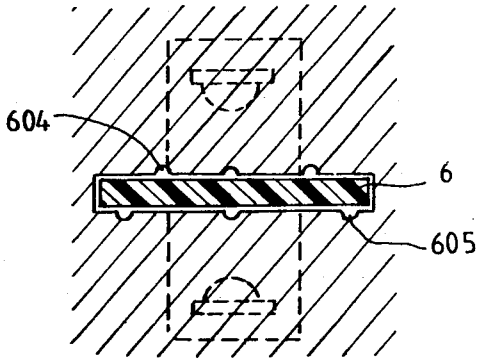
FIG. 4 is a section through IV—IV of FIG. 3.

In FIG. 2, where certain parts have been omitted for the sake of simplicity, it can be seen that the lateral edges of the screen are guided in grooves 602–602*a* formed in the wall of the case in a plane perpendicular to the parallelepipedic housing 101 which contains the contacts, the propeller and the lock. Once the screen has penetrated into slot 603 formed in the front wall 102 which defines this housing and extends the housing of the screen, it is clear that, because of the presence of the oblique insulating dividing walls 2020 and 3030, the internal volume of the case is divided into two chambers between which the air can only pass through the lateral clearance which exists between the screen and the grooves, edge 601 coming into complete abutment against the bottom of slot 603. It is important for this lateral clearance to be very small, for example less than 1/5 of the thickness e of the grooves. By way of example, the clearance will be less than 2/10 mm.

Slot 603 communicates with the outside through gas removal means such as baffles 604 and channels 605 forming expansion chambers 606.

The distance $d_2$ between the contact point of the contact pieces and the bottom of the slot is relatively small so that the path of the arc which is formed between the contact pieces is not considerably lengthened when the screen pushes it back towards the slot. The essential phenomenon is that the arc is completely sheared without ever having had the time to stabilize itself and experience shows that the result is an increase of the arc voltage as abrupt as that which occurs in a fuse, so extremely rapid extinction and considerable reduction (by a factor given by way of indication of the order of 2 to 3) of the energy of the arc with respect to what happens in the absence of this phenomenon of an abrupt reduction of the section S of the arc to substantially zero value.

It is known that the arc voltage is equal to the product of the electric field E multiplied by the arc length l and so:

$E1=R_aI$, I being the current and $R_a$ the arc resistance, itself equal to $1/\sigma S$, $\sigma$ being the conductivity of the arc.

It can be deduced therefrom that $E=I/\sigma S$, from which it follows that it is possible to increse E, so the arc voltage, by reducing the section S. According to the invention, S is practically reduced to zero, so that E becomes very large, with an extremely rapid rise of the arc voltage. This result is only obtained if shearing is practically complete, whence the requirement of causing the front edge of the screen to abut against an insulating surface with which the mechanical contact will be as good as possible: between complete shearing and simple flattening of the arc, the difference is absolutely critical.

It is essential for the arc not to have the time to stabilize itself between the contacts, for it would cause damage thereof more or less rapidly; experience has shown that this result is obtained if the moving speed of the screen exceeds 2 m/s and is preferably of the order of 10 m/s. It will be noted that too high a speed (for example greater than 20 m/s) would cause a power drift which would be too high, with generation of shock waves likely to cause the case to explode. It is obvious that the speed limits depend on multiple factors: intensity of the assumed current, volume of the arc chamber, etc.; but, in each application, the speed can be controlled and its optimum value determined, provided that the means for propelling the screen are, as explained above, essentially separate from the lock.

It is necessary for the front edge of the screen to have reached the appropriate speed when it touches the arc: this is why the above mentioned distance $d_1$ should have an appropriate value.

Another essential condition for producing the critical phenomenon of very rapid extinction of the arc by complete shearing is that no leak path should be offered thereto; whence the importance of the sealing and small lateral clearance arrangements describes above.

It will be noted that, in the above described structure, the screen completely insulates the contact supports from each other, thus doing away with any risk of welding: this function of the screen is already known.

Taking into account the rapidity of extinction, the screen cannot be metallized by the arc and, consequently, the performance of the apparatus is not adversely effected by repetitive breaking operations. Such a device may thus be used even in contactors.

The gas removal means are obviously intended to prevent an excessive increase of the pressure inside the arc chamber.

The device described may be used for very different applications and according to a great variety of embodiments.

The slot for receiving the front edge of the screen may be omitted in certain cases, the screen then coming into abutment against a flat surface or otherwise shaped so as to ensure adequate mechanical contact, with sealing, between the screen edge and said surface. It should however be noted that the use of a slot, associated with gas removal means, avoids bouncing of the screen which reaches the wall at high speed.

The screen may be given different profiles and, for example, comprise on its front edge a blade of smaller thickness which extends it and penetrates into the slot. Said blade may be situated in the longitudinal plane of symmetry of the screen, as shown in FIG. 5, where such a median blade 607 has been shown on the lateral faces of which the contact pieces 201 and 301 come to bear in the closed condition of the switch: contact is then provided by a conducting piece 608 incorporated in blade 607. Circuit breaking takes place when this piece is moved with respect to contact pieces 201 and 301. At the end of the circuit breaking movement, it is then not necessary for the front edge 6071 of the blade to abut against the bottom of slot 603: it is the shoulders 6072 and 6073, formed between the thick part of the screen and the blade, which will come into abutment against the insulating surface 102 on both sides of the entrance to the slot and it is at these abutment points that shearing of the arc will occur.

The device of FIG. 5 further comprises the same members, not shown, as that of FIGS. 1 to 4 and the contact supports 2 and 3 are pivotable.

Figure 22:
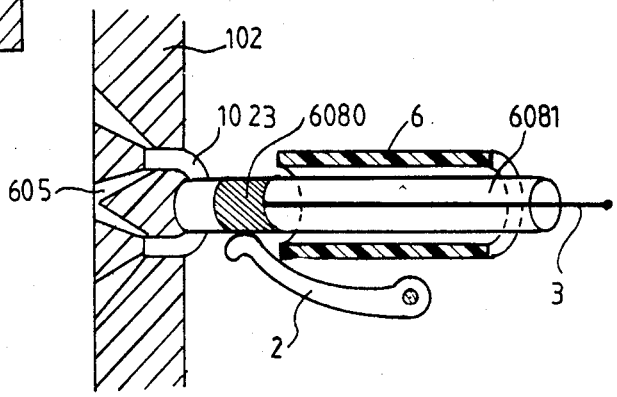
FIG. 22 shows a variant where the screen has the shape of a cylindrical ring.

In FIG. 22 has been shown a screen 6 in the shape of a cylindrical ring guided by a cylindrical insulating column 6081 in which is embedded a fixed contact 3 which ends at a surface conducting area 6080 in the form of a ring. The front end of this column is integral with the wall 102 of the case surrounded by a groove 1023 into which the front edge of screen 6 penetrates when it is propelled by means, not shown, at the time when a mobile contact 2 pivots for movement away from the area 6080. The screen 6 thus completely separates the two contacts from each other and the arc is stifled inside groove 1023. This latter communicates with gas removal channels 605 on each side of column 6081.

In FIG. 6, an embodiment of the device of FIG. 5 has been shown in which a single pivoting contact 2 is provided.

The blade **607*a* extends the base of the thick body of the screen and thus forms a staircase step which penetrates into slot 603 and comes into abutment (by surface 6072*a*) against wall 102 as indicated above. The conducting piece 608*a* embedded in the blade is then connected to an electrical connection 609 embedded in the screen, for forming the fixed contact. This Figure shows the shape of the case with the grooves for guiding the screen. The gas removal channels are designated by 610. Contact 2 pivots upwardly as contact piece 608*a* undergoes a translational movement and comes into slot 611**.

Figure 7:
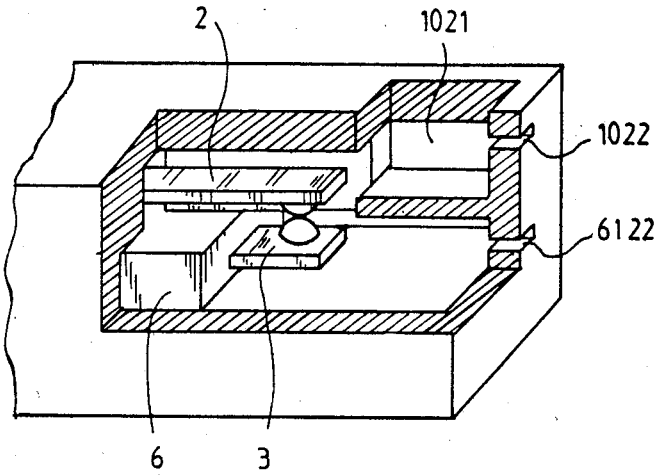
FIG. 7 is a partially exploded perspective view of a switch device in which the non-pivoting contact is embedded in the screen.
Figure 9:
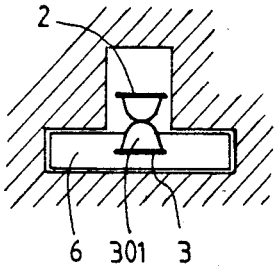
FIG. 9 is a section through IX—IX of FIG. 8.
Figure 8:
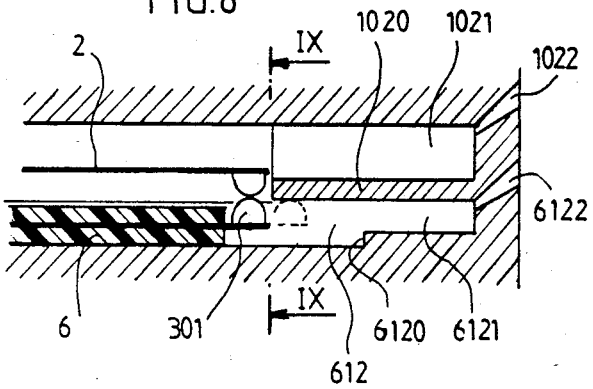
FIG. 8 is a longitudinal section of this switch device.

In the variation of FIGS. 7 to 9, where a fixed contact 3 is also embedded in screen 6, this latter is not extended by a thinner blade and it penetrates, with the contact piece 301, into a housing 612 of the case. The lower half of screen 6, situated below contact 2, then comes to stop against a shoulder 6120 formed inside this housing, whereas contact piece 301 penetrates into a narrower extension 6121 of this housing. The mobile contact 2 pivots under the action of the lock, not shown, opposite the edge of a dividing wall 1020 which defines, on one side, the housing 612 and, on the other, an arc expansion chamber 1021.

In FIG. 9 the position of the fixed contact piece 301 has been shown with broken lines at the moment when the arc is initiated: it can be seen that this latter is then sheared by an oblique shear in the vicinity of the lower edge of dividing wall 1020 and between the lower surface of this dividing wall and the closely adjacent upper surface of the screen (the clearance between these two surfaces is for example less than 2/10 mm).

In this variation, since the arc is initiated on both sides of the dividing wall 1020, means for removing the ionized air 1022–6122 are provided on both sides. The same also goes for the embodiment of FIG. 6, in which the arc is sheared, on the one hand between the front face 102 of dividing wall 1020 and shoulder **6072*a* and, on the other hand, between the lower face of dividing wall 1020 and the upper face of the step 607*a***.

Figure 10:
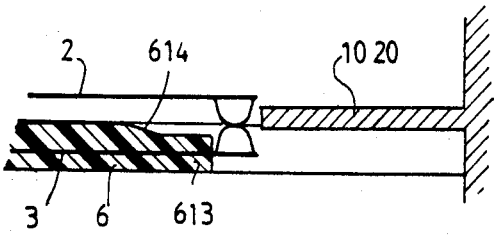
FIGS. 10 and 11 show a variant of FIG. 8.
Figure 11:
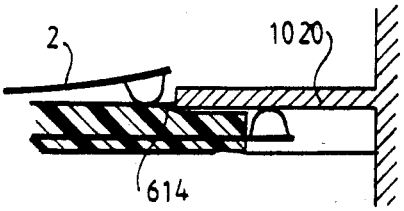

FIGS. 10 and 11 show schematically one embodiment of the device of FIGS. 7 to 9 where the endmost part of the screen comprises a portion of smaller thickness 613 connected to the main body by an inclined ramp 614. This arrangement improves shearing of the arc, the main body of the screen and the ramp then stopping this latter and shoulder 6120 of FIG. 9 is here useless.

Figure 12:
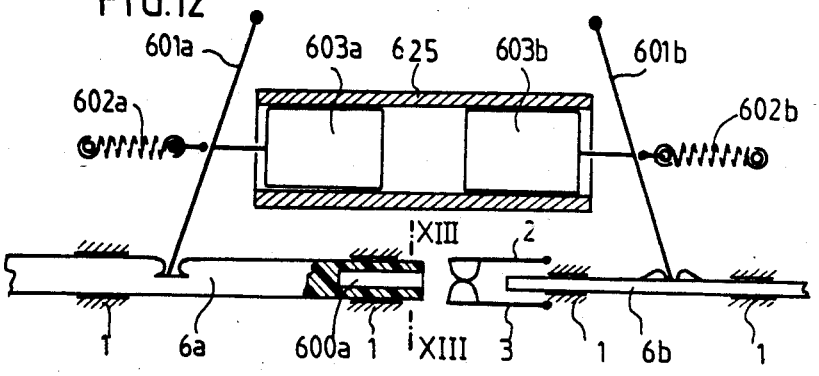
FIGS. 12 and 14 show schematically and partially a switch device comprising two screens in mutual engagement.
Figure 13:
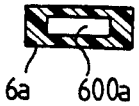
FIG. 13 is a cross section of the end of the screen 6*a*, through XIII—XIII of FIG. 12 and a partial section of the case.

In all the above embodiments, a single screen, moveable in translation parallel to the contact supports in their rest position cooperating with an insulating surface shears the arc by shearing perpendicularly to its natural path, or more or less obliquely with respect to said path but, in any case, not tangentially. This same type of shearing may be obtained with quite different structures of the screen and of the insulating surface and different translational movements. By way of example, a device has been shown in FIGS. 12 to 14 comprising two screens 6*a* and 6*b* moveable in translation with respect to case 1 and whose facing endmost portions have a complementary shape, so that the front edge of the thin screen 6*b* will, at the end of the opening position of the pivoting contacts 2–3, be engaged to the very bottom of the narrow open housing 600*a* of the screen 6*a*. In this final position where the arc is completely extinguished, contacts 2 and 3 are moved apart and disposed on each side of the end of the two endmost portions, fitted one into the other, of two screens, so that the case is divided into two chambers sealed from each other (for this the screens slide in appropriate grooves in the case).

Figure 14:
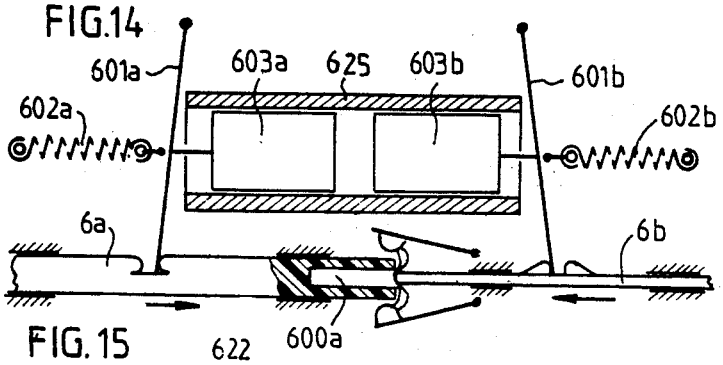

In an intermediate position, shown in FIG. 14, the arc begins to be sheared between the edges of the opening of housing 600*a* and the front edge of the screen 6*b*.

By way of example, a means for propelling the screen has been shown, comprising two pivoting levers 601*a* and 601*b*, normally held in the spaced apart position by respective springs 602*a* and 602*b* and which draw closer together under the action of two magnetic cores 603*a*, 603*b* controlled by a coil 625, until they come into contact with each other.

In all the above devices, at least one of the contacts is pivoting or moves resiliently to one side to let the screen pass.

Figure 15:
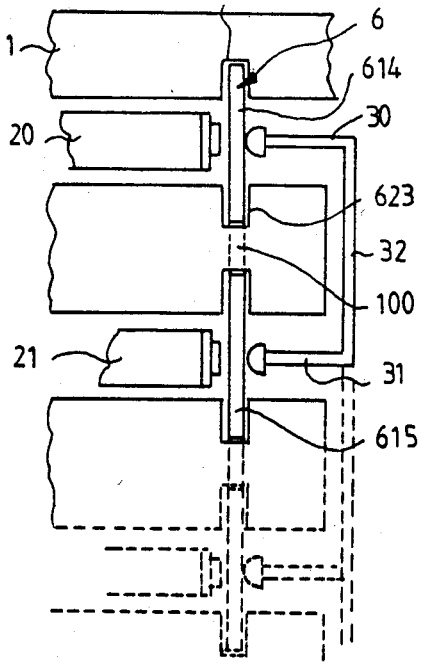
FIGS. 15 and 16 illustrate one embodiment in which the screen has the shape of a comb.
Figure 16:
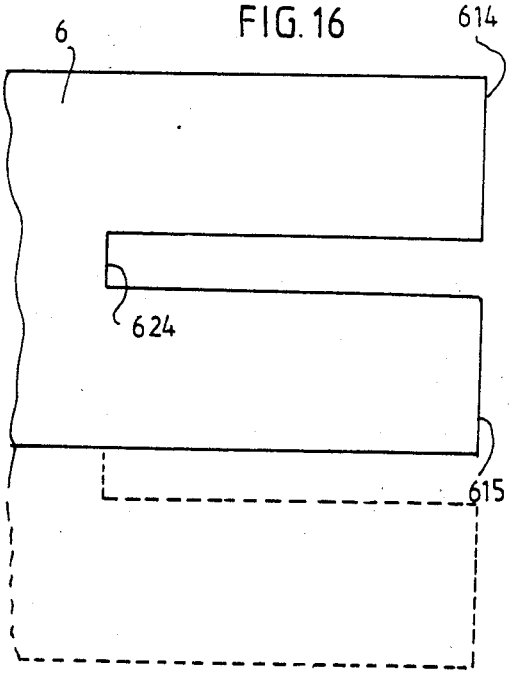

In FIGS. 15 and 16 a screen structure has been shown in the form of a comb intended to be inserted between fixed contacts such as 20–21 and mobile contacts such as 30–31 by a traaslational movement perpendicular to the screen. With this structure, devices having multiple contact pairs (bridge of mobile contacts 3) may be formed. Each tooth of the comb formed by the screen is guided by its lateral edges in grooves such as 622–623 formed in dividing walls provided in case 1. The bottom of the gaps 624 between fingers stops the screen by abutment narrow parts 100 of these divding walls. These dividing walls, situated upstream of the contacts with respect to the movement of the screen, prevent the arc from developing between the contacts situated on the same side of the screen.

The insulating surface portion against which the ends 614–615 of the fingers come into abutment for causing shearing of the arc is not shown in the drawing.

Figure 17:
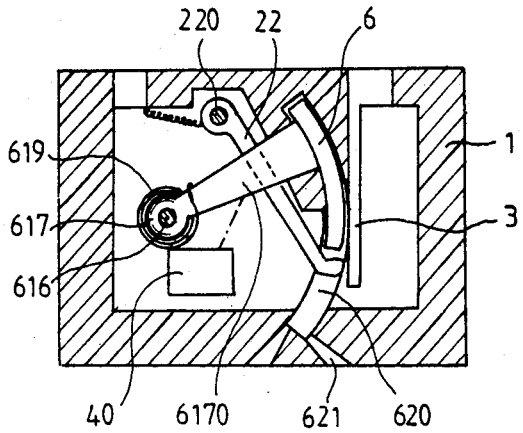
FIGS. 17 and 18 show a switch device in which the screen undergoes a circular translational movement seen, in FIG. 17, in section through XVII—XVII of FIG. 18.
Figure 18:
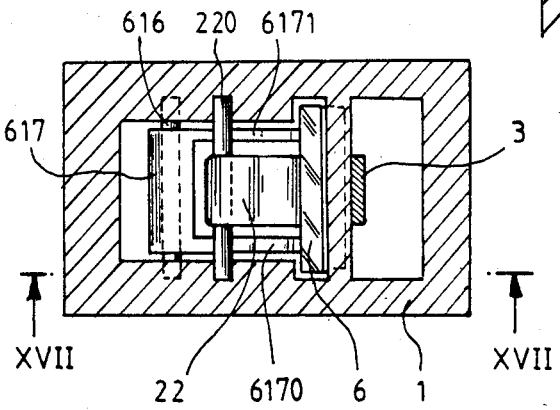

Instead of providing a rectilinear translational movement of the screen, it is further possible to form a screen with circular translation, as shown in FIGS. 17 and 18. A shaft 616 whose ends are journalled in two walls of case 1 supports a stirrup piece 617 whose legs 6170–6171 support a screen 6 in the form of a cylindrical ring portion adapted to move in a groove 620 whose bottom communicates with the outside through vents such as 621. Propulsion of the assembly is provided by a spiral pre-loaded spring 619 tripped by means shown symbolically at 40. The mobile contact 22 is mounted for pivoting about a shaft 220 parallel to shaft 616 and which is also journalled in two walls of the case. The end of contact 22 penetrates into the groove when the screen is in the rest position so as to come, in the closed position shown, into contact with the fixed contact 3.

On opening of the contacts, controlled by a lock not shown, pivoting of contact 22 (in a clockwise direction as shown in FIG. 17) moves its end away from contact 3 and, moreover, the spring is tripped and the screen effects a circular translational movement in the same direction as contact 22, so as to come into abutment against the lower bottom of the guide housing 620; final shearing of the arc occurs therefore between this lower bottom and the lower edge of the screen.

Figure 19:
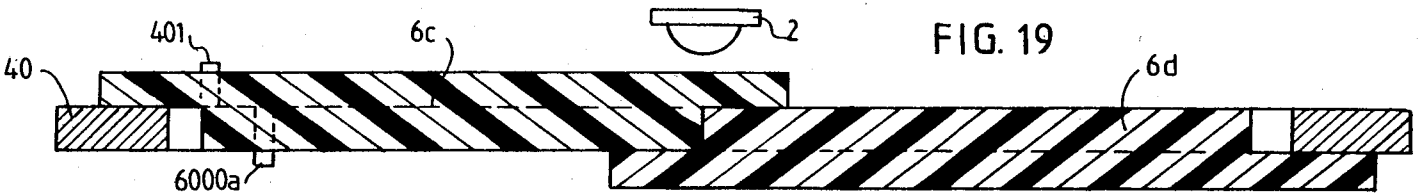
FIGS. 19 to 21 show a device with two screens in the shape of pivoting half disks.
Figure 21:
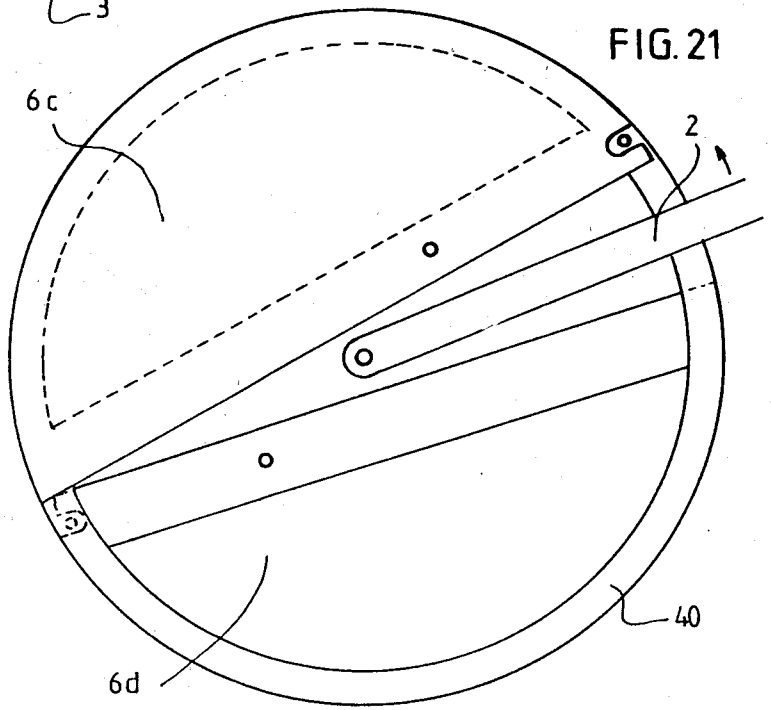
Figure 20:
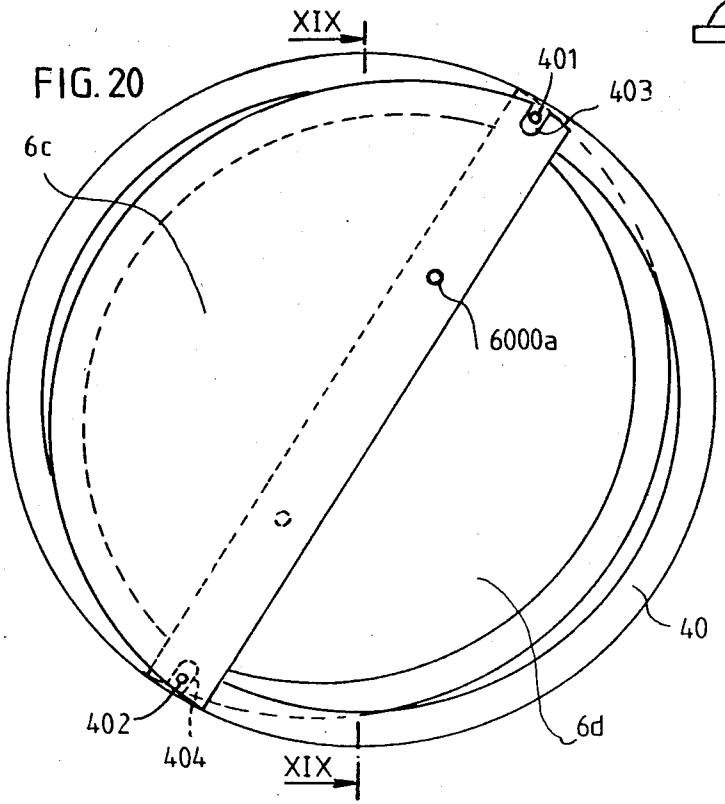

In FIGS. 19 to 21, a device has been shown formed of two screens 6*c* and 6*d* which is inserted between two contacts 2 and 3, which, on opening of the complete apparatus (not shown), move away from each other perpendicularly to the screens. Each screen comprises two interlocked parts, each one slightly smaller than a half circle, namely an external part and a base. This latter comprises a pivoting shaft, such as 6000*a*, fixed to the case, not shown, of the apparatus.

A ring 40, itself mounted in the case so as to be able to rotate on itself when it is actuated by a propelling means not shown, comprises two diametrically opposite pins 401 and 402 which are engaged respectively in indentations 403 and 404 which the respective external parts of the two screens comprise. Rotation of the ring results therefore in causing each of the screens to rotate about a fixed off centered axis. As shown in FIGS. 19 and 20, in which the screens have been shown in their position at the end of opening of the contacts, the bases of the two screens are situated in the plane of the ring and are applied against each other by their rectilinear edge, whereas the outer part of each screen partially covers the base of the other, so that the path of the arc, open in the position of FIG. 21, is completely interrupted by shearing between the cooperating surfaces of the two screens.

It is obvious that different embodiments may come to the mind of a man skilled in the art, without for all that departing from the scope and spirit of the invention.

What is claimed is:

1. A switch comprising:

a housing made of dielectric material;

a pair of electrical contacts mounted within the housing wherein at least the first one of the contacts is mounted for movement between open and closed positions with respect to the second contact;

first means for moving said first contact from said closed to said open position;

a screen made of dielectric material said screen having a forward surface portion adapted for engagement with a cooperating surface portion located within the housing;

means mounting the said screen within the housing for movement from a first position in which the said forward surface portion is located on this side of the first contact to a second intermediate position in which the said forward surface portion is located facing the second contact and a third position in which the said forward surface portion is beyond the second contact, in engagement with the said cooperation surface portion;

and second means, physically independent of said first means, for propelling the said screen from the first to the second position thereof at a speed between 2 m/s and 20 m/s simultaneously with the movement of the said contact from closed to open position, but independently of said movement, the contacts being separate from each other to allow the free passage of the said screen when the said screen reaches the said second position.

2. A switch comprising:

a housing made of dielectric material;

a pair of electrical contacts mounted within the housing wherein at least the first one of the contacts is mounted for movement between open and closed positions with respect to the second contact;

first means for moving said first contact from said closed to said open position;

a screen made of dielectric material, said screen having a forward edge surface portion adapted for engagement with a cooperating surface portion located within the housing;

means mounting the said screen within the housing for translation from a first position in which the said forward edge surface portion is located on this side of the first contact to a second intermediate position in which the said forward edge surface portion is located between the contact and a third position in which the said screen of said forward surface portion is beyond the contacts in engagement with the said cooperating surface portion;

and second means, physically independent of said first means, for propelling the said screen from the first to the second position thereof at a speed between 2 m/s and 20 m/s simultaneously with the movement of the said contact from closed to open position, but independently of said movement, the contacts being separate from each other to allow the free passage of the said screen when the said screen reaches the said second position.

3. The switch as claimed in claim 1 or 2, wherein the said screen is shaped as a blade having two longitudinal parallel edges which are guided in two respective grooves formed in the walls of said housing; the said cooperating surface portion is a slot which is formed in a further wall of said housing, said slot being connected directly to the atmosphere by a gas removal channel; the said forward surface portion penetrates into said slot and the screen divides the housing into two chambers insulated from each other and connected to the atmosphere.

4. The switch as claimed in claim 3, wherein the said blade is extended forwardly by a further blade of smaller thickness forming therewith at least one shoulder which comes into abutment against said further walls.

5. A switch comprising:

a housing made of dielectric material;

a plurality of pairs of electrical contacts mounted within the housing, wherein at least the first one of the contacts of each pair is mounted for movement between open and closed positions with respect to the second contact;

first means for simultaneously translating the first contacts of the respective pairs from said closed to said open position;

a screen made of dielectric material, said screen having respective forward edge surface portions adapted for engagement with respective cooperating surface portions located within the housing;

means mounting the said screen within the housing for movement from a first position in which the said forward edge surface portion is located on this side of the contacts to a second intermediate position in which the said forward edge surface portion is located between the contact and a third position in which the screen is located between the forward second contacts of the respective pairs, and the said forward edge surface portions are beyond the contacts in engagement with the said respective cooperating surface portions;

and second means, physically independent of said first means, for propelling the said screen from the first to the second position thereof at a speed between 2 m/s and 20 m/s simultaneously with the movement of the said first contacts from closed to open position, but independently of said movement, the contacts being separate from each other to allow the free passage of the said screen when the said screen reaches the said second position; the said screen being shaped as a comb structure located in a plane substantially at right angles with the direction of the translation of the first contacts, said comb structure having a plurality of finger shaped portions located in respective parts of said plane passing between the first and the second contacts of the respective pairs.

6. The switch as claimed in claim 3, wherein the said first and second contacts are respectively mounted on first and second elongated conducting support blades and at least the first support blade is pivotally mounted about an axis which is substantially parallel to said screen.

7. The switch as claimed in claim 6, wherein the screen blade is rearwardly extended by a thicker portion and a portion of the second support blade is embedded in the said thicker portion.

8. The switch as claimed in claim 6, wherein a portion of the second support blade is embedded in the screen and the said slot has a shoulder on which abuts a portion of the forward edge of the screen and forms a housing for said second contact.

9. The switch as claimed in claim 6, wherein a portion of the second support blade is embedded in the screen and the said forward portion of said screen is a ramp surface portion which is inclined with respect to the forward edge of said screen.

10. The switch as claimed in claim 3, wherein the said slot is formed within an end portion of a further screen which is mounted for translation in the same plane as the first screen.

11. The switch as claimed in claim 2, wherein the said screen is shaped as a portion of a cylindrical ring mounted for circular translation in a channel of the same shape.

12. The switch as claimed in claim 2, wherein said screen has the shape of a cylindrical sleeve guided along a fixed column which is integral with the said housing and whose surface bears the said second contact, the front edge of this sleeve penetrating into a circular groove provided in said housing.

13. A switch comprising:

a pair of electrical contacts of which at least a first one is pivotally mounted for movement between open and closed position with respect to the second contact;

first means for moving said first contact from said closed to said open position;

a screen made of dielectric material and located in a plane passing between the said contacts substantially at right angles with the path of motion of said first contact;

said screen comprising first and second screen portions, each substantially shaped as a half-circle and having a substantially diametrical edge surface portion;

and means for pivoting the said respective screen portions about two respective off centered axes which are at right angles to the plane of said screen and symmetrically arranged with respect to the path of movement of the first contact from a first position in which the edge surface portion of the respective screen portions will be separated from each other at the level of said path to a second position in which the said edge surface portion will be juxtaposed or overlapping at the level of said path.

* * * * *